US005782444A

United States Patent [19]

Anderman et al.

[11] Patent Number: 5,782,444

[45] Date of Patent: Jul. 21, 1998

[54] CABINET SKATE

[75] Inventors: Terry J. Anderman, Woodstock, Ga.; Kirk Wurdack, Chattanooga, Tenn.

[73] Assignee: Interface, Inc., Atlanta, Ga.

[21] Appl. No.: 638,496

[22] Filed: Apr. 26, 1996

[51] Int. Cl.[6] ..... A47B 91/00

[52] U.S. Cl. ..... 248/188.8; 248/188.4; 29/243.52

[58] Field of Search ..... 248/188.8, 188.4, 248/649, 650, 677, 678, 405, 346.5, 501

[56] References Cited

U.S. PATENT DOCUMENTS

| | | | |
|---|---|---|---|
| 2,828,219 | 7/1958 | Heiges et al. . | |
| 3,400,008 | 9/1968 | Bleyle et al. . | |
| 4,025,676 | 5/1977 | Koellisch . | |
| 4,299,019 | 11/1981 | Roebuck | 29/243.52 |
| 4,486,492 | 12/1984 | Ziliotto . | |
| 4,589,622 | 5/1986 | Hutter | 248/649 |
| 5,050,829 | 9/1991 | Sykes | 248/188.8 |
| 5,142,734 | 9/1992 | Looman et al. | 248/188.4 |
| 5,261,643 | 11/1993 | Wurdack . | |
| 5,469,599 | 11/1995 | Wurdack . | |

FOREIGN PATENT DOCUMENTS

| | | |
|---|---|---|
| 1029159 | 4/1978 | Canada . |

*Primary Examiner*—Leslie A. Braun
*Assistant Examiner*—Willie Berry, Jr.
*Attorney, Agent, or Firm*—Kilpatrick Stockton LLP; John S. Pratt; Michael F. Labbee

[57] ABSTRACT

The present invention comprises a dish-shaped cabinet skate made of an ultra high molecular weight polyethylene, which is applied to furniture feet. The skate is adapted to be affixed in a permanent or semi-permanent manner on standard office furniture feet. The skate has an inherently low coefficient of friction with respect to conventional carpeting, thus allowing easy sliding. The skate is shaped to include large radius bends at the edges and a slight crowning of the bottom surface to further reduce resistance to sliding.

15 Claims, 1 Drawing Sheet

CABINET SKATE

FIELD OF THE INVENTION

The present invention relates to a skate for affixing to the feet of desks, filing cabinets, partitions and other modular and conventional office furniture so that the furniture can be easily moved by sliding it across the floor surface, particularly carpeting.

BACKGROUND OF THE INVENTION

It is often necessary to move office furniture, such as desks, bookcases, partitions and filing cabinets, about an office. The need to move the furniture about may arise from a desire to reconfigure the office space or to perform maintenance, such as carpet cleaning or removal and replacement. For example, modular carpet is designed to be installed in occupied office areas with furniture and equipment in place. During installation, furniture and equipment is moved a short distance or lifted while the old flooring is removed and squares of new modular carpet installed. The office furniture or equipment is then slid or lowered into place, permitting installation of new carpet without breaking down work stations, disrupting telecommunication or computer hookups and avoiding business interruptions.

Office furniture can be quite heavy, making such movements difficult and subjecting workers to strain and potential injury. To ease this burden, hand trucks are often used to move the furniture. Also, complex mechanisms for lifting the furniture so that carpet can be removed and replaced beneath the furniture can be used, such as that disclosed in U.S. Pat. No. 5,261,643 to Wurdack. Likewise, slides may be used which can be placed under a portion of the furniture being moved to reduce the friction between the carpeting and the furniture, as disclosed in U.S. Pat. No. 5,469,599 to Wurdack. These approaches allow the furniture to be moved as desired, but are temporary solutions. The mechanisms cannot be left in place after the move is completed for logistical and aesthetic reasons. In some situations, however, the need to move furniture arises frequently. As a result, repeated installation and removal of such mechanisms becomes necessary.

There are coasters and slides for use under furniture legs, primarily for home and residential use, which protect carpet or other floor surfaces from denting and allow the furniture to be slid. Such coasters and slides tend to easily separate from the furniture, thus defeating their purpose. Such coasters or slides also are made of materials that do not substantially reduce the friction between the furniture and the carpet, particularly when used with heavy office furniture. Furthermore, coasters and slides tend to be manufactured with relatively squared off edges that increase resistance to sliding.

SUMMARY OF THE INVENTION

The present invention comprises a cabinet skate, which is a dish-shaped cover applied to furniture feet. The skate is adapted to be affixed in a permanent or semi-permanent manner on standard office furniture feet. The skate remains substantially hidden from view when installed and is attractive. Thus it can be left on the furniture between moves.

The skate is made of an ultra high molecular weight polyethylene that has an inherently low coefficient of friction with respect to conventional carpeting, thus allowing easy sliding. The skate is shaped to include large radius bends at the edges and a slight crowning of the bottom surface. These features act in concert to create a angled attack face in the direction of motion to further dissipate resistance to movement.

Accordingly, it is an object of the present invention to provide a cabinet skate that is easily installed on conventional furniture feet in a permanent or semi-permanent fashion.

It is another object of the present invention to provide a cabinet skate that is unobtrusive.

It is another object of the present invention to provide a cabinet skate that is sufficiently small to be permanent.

It is yet another object of the present invention to provide a cabinet skate that is made of a material that provides a low coefficient of friction with respect to conventional carpeting.

It is still another object of the present invention to provide a cabinet skate that is shaped to reduce resistance to sliding.

Other objects, features and advantages of the present invention will become apparent with reference to the remainder of the written portion and the drawing of this application.

DETAILED DESCRIPTION OF THE DRAWINGS

Figure 1:
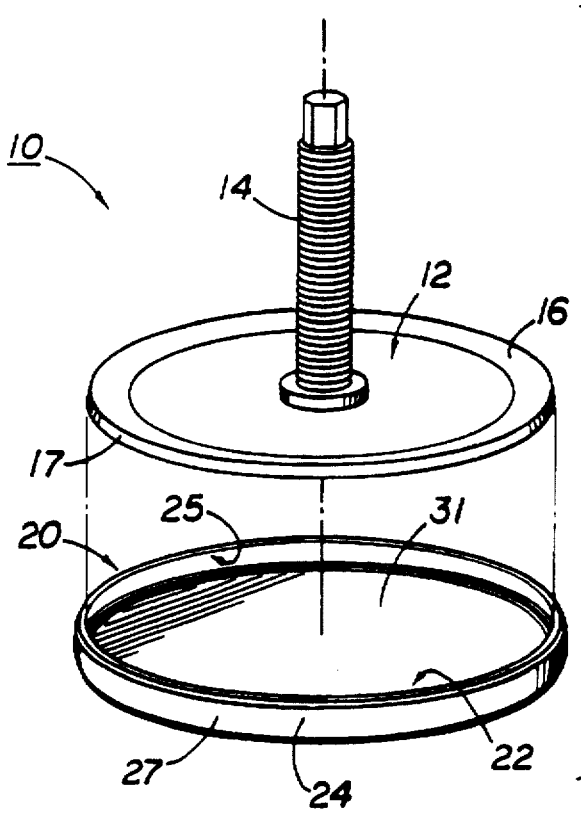
FIG. 1 is a perspective view of a cabinet skate consistent with the present invention shown prior to installation on a conventional furniture foot.

FIG. 1 illustrates a conventional furniture foot 10, which comprises a base plate 12 and a threaded support 14. Base plate 12 is typically circular in shape and constructed of stamped sheet metal. Base plate 12 typically has a upturned flange portion 16 about its periphery, although not all furniture feet include this feature. Support 14 is typically a threaded rod and is adapted to screw into the bottom of furniture (not illustrated).

Cabinet skate 20 is generally dish shaped and molded or otherwise formed in one piece from a high strength, low friction material. Suitable materials include ultra high molecular weight polyethylene sold under the trademark TIVAR or the like. (TIVAR is a registered trademark of the Poly-Hi/Menasha Corporation.) Ultra high molecular weight polyethylene (e.g., TIVAR-100) is resilient and has high shock strength, properties that ensure the durability of cabinet skate 20. Other suitable materials for cabinet skate 20 should have substantially the same properties as TIVAR-100 in coefficient of friction, abrasion resistance and flexibility. TIVAR-100, for example, has static and dynamic coefficients of friction against steel of 0.18 and 0.13, respectively (USTM method D1894), an abrasion index of 10 (USTM sand slurry method relative to steel at 100) and a modulus of elasticity in tension of 1.02 (USTM method D747, $10^3$ p.s.i.). Other plastics with coefficients of static and dynamic friction equal or less than about 0.18 and 0.13, respectively, an abrasion index equal to or greater than about 10 and a modulus of elasticity equal to or grater than about 1.02 may be suitable. Candidates include some polytetrafluoroethylenes (e.g. Teflon), some nylons or copolyesters. However from the standpoint of cost relative to performance, ultra high molecular weight polyethylene is preferred.

Because of the heavy weight of office furniture and equipment, skate 20 can become very hot as it is slid across the floor. Therefore the material selected for skate 20 must be capable of withstanding high temperatures without blistering or otherwise deforming. Ultra high molecular density polyethylene has been found entirely satisfactory and is therefore preferred for this reason in addition to its desirable characteristics of lubricity, abrasion resistance and flexibility.

Figure 2:
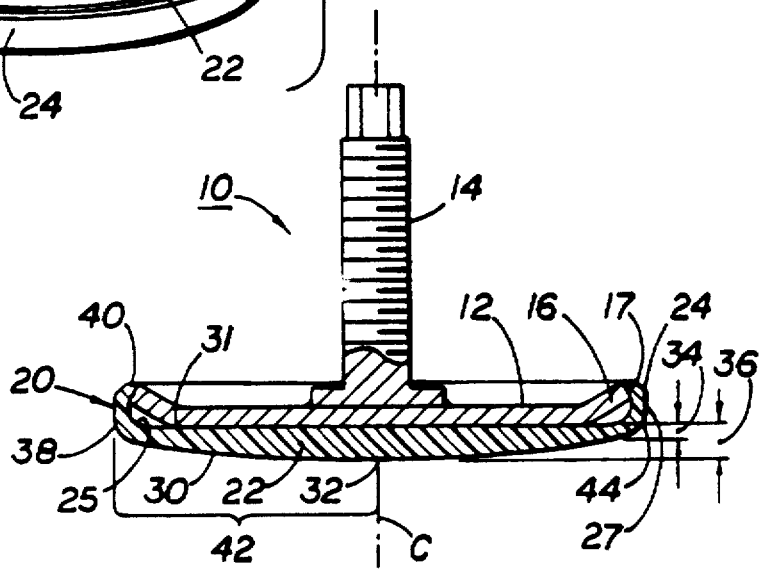
FIG. 2 is a side sectional view the cabinet skate of FIG. 1.

As can be seen in FIGS. 1 and 2, skate 20 is dimensioned to generally conform to the size and shape of base plate 12. Thus, skate 20 is relatively unobtrusive when installed, appearing to the eye as part of the furniture foot itself. As a result, skate 20 may be installed without impinging on the aesthetics of the furniture. Furthermore, because of the small size and consequent low cost, skate 20 can be used on all the furniture in an office without undue expense. Thus, in offices where frequent moving of furniture is required, skate 20 may be installed and left on the furniture indefinitely.

Skate 20 is molded in one piece to form support web 22 which transitions to retaining wall 24 at transition portion 38. When installed, baseplate 12 rests against upper face 31 and sliding face 30 rests on the carpeting (not illustrated).

Figure 2A:
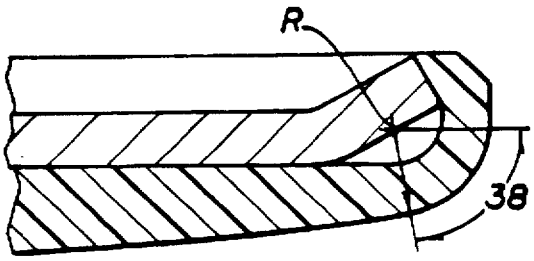
FIG. 2A is a partial sectional view of the cabinet skate of FIG. 1.

Referring to FIG. 2, sliding face 30 is generally planar with a slight central crown 32. Crown 32 is formed through a gradual increase in the thickness of support web 22. For instance, if web 22 is of a thickness 34 at transition portion 38, web 22 gradually increases to a thickness 36 at center C of skate 20. As can be seen in FIG.2A, transition portion 38, i.e., the region where sliding face 30 meets outer face 27, is characterized by a relatively large radius R. Sliding face 30 can also be flat (not illustrated).

Referring again to FIG. 2, crown 32 and transition portion 38 act in concert to present an angled attack face to the surface (not illustrated) upon which skate 20 is to be slid. In other words, if skate 20 is resting on carpet (not illustrated) and pushed in direction X, portion 42 of web 22 is the "leading edge" of skate 20, i.e., the portion of skate 20 that is pushing against the pile of the carpet. The pile of the carpet resists most strongly against portion 42 of skate 20. Because crown 32 acts to create a conical profile and because transition portion 38 provides a long sloping area between the vertical wall 24 and web 22, the carpet "sees" something akin to a boat hull. Much as a boat hull parts the water before it and creates a tendency for the boat to rise and plane on the surface of water, crown 32 and transition portion 38 act to part the pile of the carpet and urge skate 20 to rise and plane on the surface of the pile.

Figure 2B:
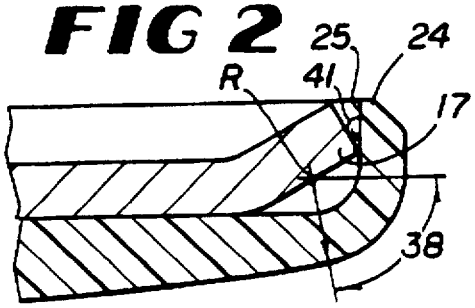
FIG. 2B is a partial sectional of an alternate embodiment of the skate of FIG. 1.

Wall 24 is generally uniform in thickness and rises vertically from web 22, except that the top portion of wall 24 turns slightly inward to form lip 40. Lip 40 is positioned to match outer edge 17 of base plate 12. Thus, when base plate 12 includes flange 16, lip 40 is positioned near the top of wall 24. If base plate 12 does not have a flange, lip 40 is positioned at a lower point on wall 24, or the height of wall 24 is simply reduced. When skate 20 is installed, lip 40 curves over outer edge 17 and, by virtue of skate 20 being sized to closely match the circumference of base plate 12, firmly grips outer edge 17. In this manner, skate 20 is securely retained on base plate 12, even when confronted with forces generated when the furniture is slid over carpeting. Other means of retaining base plate 12 may be employed. For example, as illustrated in FIG. 2B, rather than curving wall 24 inward to form lip 40, an inwardly protruding bead 41 may be formed on inner surface 25 along the top of wall 24 that "snaps" over outer edge 17 of base plate 12.

Skate 20 is installed on each foot of a piece of furniture and on all furniture in an office. Because skate 20 is unobtrusive, it may be installed and left on the furniture indefinitely. Thereafter, whenever furniture must be moved, the furniture may simply be slid into the desired position. As noted above, skate 20 reduces the resistance to sliding, and therefore the force required to move the furniture, relieving the worker from undue stress and strain. Skate 20 may also be provided in combination with foot 10 as a substitute foot. This is particularly useful when the existing foot plate is a size that cannot accommodate skate 20.

Although the foregoing is provided for purposes of illustrating, explaining and describing embodiments of the present invention, modifications and adaptations to these embodiments will be apparent to those skilled in the art and may be made without departing from the scope or spirit of the invention.

We claim:

1. A cabinet skate for attaching to a furniture foot comprising:

a) a web with a top surface, a bottom surface, a center and an outer perimeter in which the thickness of the web gradually increases from the perimeter to the center thereby forming a crown on the bottom surface; and b) a retaining wall protruding from the top surface at the perimeter, the wall having an inside surface, an outside surface and means for retaining the furniture foot.

2. The cabinet skate of claim 1 in which the web is circular.

3. The cabinet skate of claim 1 in which the retaining means comprises a lip protruding from the inside surface.

4. The cabinet skate of claim 1 in which the retaining means comprises an inward curvature of the retaining wall.

5. The cabinet skate of claim 1 in which the region where the bottom surface meets the outer surface is characterized by a relatively large radius of curvature.

6. The cabinet skate of claim 1 in which the skate is molded in one piece from a material which has coefficients of static and dynamic friction against steel (USTM D1894) equal to or less than about 0.18 and about 0.13, respectively.

7. The cabinet skate of claim 6 in which the material has a modulus of elasticity in tension equal or greater than about 1.02 (USTM D747).

8. The cabinet skate of claim 7 in which the material has an abrasion resistance equal to or greater than about 10 (USTM sand slurry method).

9. The cabinet skate of claim 8 in which the material is high molecular density polyethylene.

10. A cabinet skate for attaching to a furniture foot, the skate being molded in one piece from high molecular density polyethylene which has coefficients of static and dynamic friction against steel (USTM D1894) equal to or less than about 0.18 and about 0.13, respectively, a modulus of elasticity in tension equal or greater than about 1.02 (USTM D747) and an abrasion resistance equal to or greater than about 10 (USTM sand slurry method), the skate comprising:

a) a circular web having a top surface and a bottom surface, a center and an outer perimeter in which the thickness of the web gradually increases from the perimeter to the center thereby forming a crown on the bottom surface; and b) a retaining wall protruding from the top surface, the wall having an outside surface and means for retaining the furniture foot.

11. The cabinet skate of claim 10 in which the web is crowned.

12. The cabinet skate of claim 11 in which the retaining means comprises an inwardly protruding bead.

13. The cabinet skate of claim 11 in which the retaining means comprises an inward curvature of the retaining wall.

14. The cabinet skate of claim 11 in which the region where the bottom surface meets the outer surface is characterized by a relatively large radius of curvature.

15. A furniture foot, comprising:

a) a base plate with a center, a bottom surface and a perimeter;

b) a threaded support affixed to center of the baseplate;

c) a cabinet skate affixed to the perimeter of and substantially covering the bottom surface of the base plate in which the skate is molded in one piece from high molecular density polyethylene which has coefficients of static and dynamic friction against steel (USTM D1894) equal to or less than about 0.18 and about 0.13, respectively, a modulus of elasticity in tension equal or greater than about 1.02 (USTM D747) and an abrasion resistance equal to or greater than about 10 (USTM sand slurry method), the skate further comprising:

i) a circular crowned web having a top surface and a bottom surface;

ii) a retaining wall protruding from the top surface, the wall having an outside surface; and, iii) in which the region where the bottom surface of the web meets the outer surface of the wall is characterized by a relatively large radius of curvature.

* * * * *